US006237300B1

(12) United States Patent
Carne et al.

(10) Patent No.: US 6,237,300 B1
(45) Date of Patent: May 29, 2001

(54) WALL STUD CONNECTORS

(75) Inventors: Stuart John Carne, Eastwood; Peter James Hunt, Mount Riverview; Sarah Fathinia, Cherrybrook; Campbell John Seccombe, Turramurra, all of (AU)

(73) Assignee: BHP Steel (JLA) Pty Ltd., Melbourne (AU)

( * ) Notice: Subject to any disclaimer, the term of this patent is extended or adjusted under 35 U.S.C. 154(b) by 0 days.

(21) Appl. No.: 09/242,981

(22) PCT Filed: Aug. 29, 1997

(86) PCT No.: PCT/AU97/00562

§ 371 Date: Jun. 14, 1999

§ 102(e) Date: Jun. 14, 1999

(87) PCT Pub. No.: WO98/09030

PCT Pub. Date: Mar. 5, 1998

(30) Foreign Application Priority Data

Aug. 30, 1996 (AU) ..... PO2002

(51) Int. Cl.[7] ..... E04B 1/38; E04C 5/00

(52) U.S. Cl. ..... 52/715; 52/731.9; 52/712; 52/656.9; 52/657

(58) Field of Search ..... 52/712, 715, 656.9, 52/657, 282.4, 729.5, 731.9

(56) References Cited

U.S. PATENT DOCUMENTS

| | | | | |
|---|---|---|---|---|
| 813,253 | * | 2/1906 | Sullivan | 52/715 |
| 2,413,362 | * | 12/1946 | Maxwell | 403/400 |
| 4,650,085 | * | 3/1987 | Davies | 220/4 R |
| 4,714,372 | * | 12/1987 | Commins | 403/400 |
| 4,976,085 | * | 12/1990 | Krueger | 52/715 |
| 5,327,695 | * | 7/1994 | Kelly | 52/735 |
| 5,519,976 | * | 5/1996 | Gee | 52/712 |
| 5,797,694 | * | 8/1998 | Breivik | 403/231 |

FOREIGN PATENT DOCUMENTS

| | | |
|---|---|---|
| 1175176 | 9/1977 | (AU) . |
| 2933077 | 4/1979 | (AU) . |
| 3320584 | 3/1985 | (AU) . |
| 7365691 | 10/1991 | (AU) . |
| 3372293 | 9/1993 | (AU) . |
| 9503458 | 2/1995 | (WO) . |
| 9525856 | 9/1995 | (WO) . |

* cited by examiner

*Primary Examiner*—Carl D. Friedman
*Assistant Examiner*—Kevin McDermott
(74) *Attorney, Agent, or Firm*—Baker Botts L.L.P.

(57) ABSTRACT

A tie bracket for linking adjacent end studs of two or more stud wall subframes extending at an angle to each other, comprises a shaped element of sheet metal which includes a generally polygonal centre portion (12) defining at least three margins (14) intersecting at respective corners, for being accommodated between the end studs. A plurality of tabs (20) project respectively from at least two of the margins for engaging respective apertures in the end studs. Each tab is of a length in the direction of projection greater than its width and of broadly similar order to the lengths of the longer of said margins. Respective formations (28) are provided in each of the tabs to define alternative bending lines (29) spaced in the direction of projection.

18 Claims, 8 Drawing Sheets

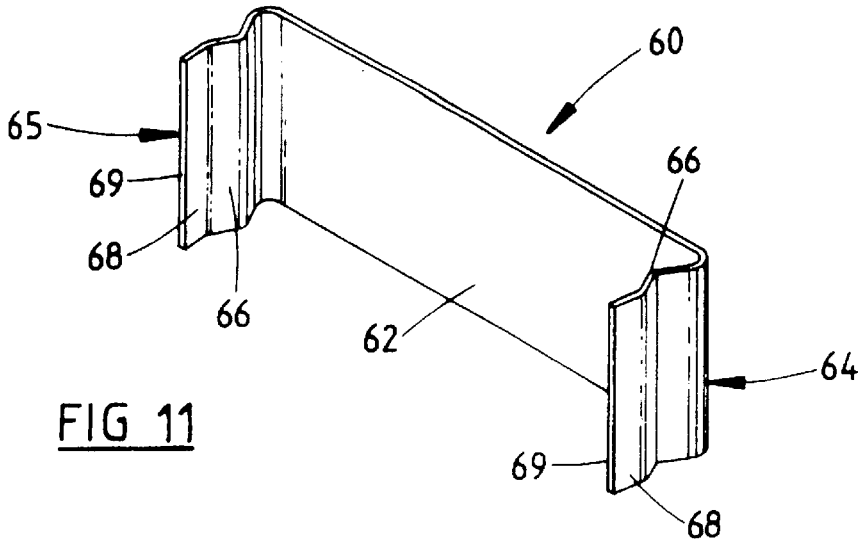
FIG 11
FIG 12
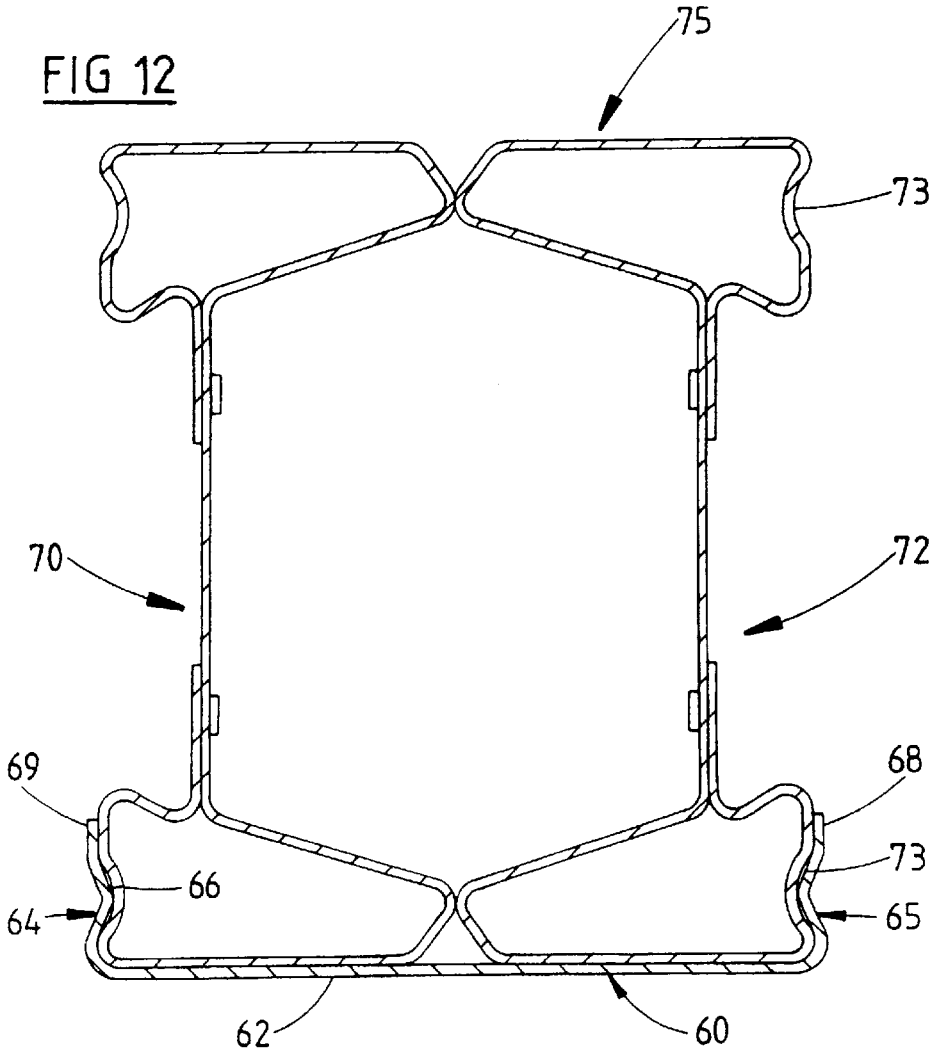

WALL STUD CONNECTORS

FIELD OF THE INVENTION

This invention relates generally to the interconnection of structural components in metal building frames and is of particular relevance to the interconnection of wall stud components of adjacent subframes.

BACKGROUND ART

The present applicant's Australian Patent 667145 discloses a structural member of a kind roll formed from a strip of metal sheet so that the strip is folded over onto itself at its lateral edges to form respective boxed edge formations linked by a web. The web and adjacent portions of the boxed edge formations define a longitudinally extending recess of dovetail cross-section. Boxed structural members of this form are well suited to serve as wall studs in steel building frames in that they provide sufficient structural strength with minimum material, while the boxing imparts sufficient rigidity to allow other frame. and cladding components to be fastened to the studs by nailing.

An earlier open form of wall stud is disclosed in applicant's Australian patent 639313.

The common practice is to deliver a steel house frame to a building site as a set of subframes and individual components. The subframes normally include stud wall subframes, each comprising an assembly of wall studs joined by top and bottom plates and by noggings. The normal practice is to commence frame erection by installing the wall subframes in position on the slab and loosely linking them together. On completion of this layout, the erection crew commences rigid fastening of the frames together before starting on the roof. It is an object of at least one aspect of the invention to facilitate the initial laying out and linking of the wall subframes.

It is another object of the invention, in one or more further aspects, to address longer term problems which may arise from in situ forces tending to separate wall subframes, which can arise e.g. from a variety of temperature effects, or from ground and frame movements.

SUMMARY OF THE INVENTION

It has been realised, in accordance with the first aspect of the invention, that the first of these objects can be met by providing a tie bracket which is configured to accommodate the studs at the intersections of adjacent subframes and to take advantage of service holes in the studs, and which can be reconfigured to act as a mid-height tie bracket linking the subframes.

The invention accordingly provides, in its first aspect, a tie bracket for linking adjacent end studs of two or more stud wall subframes extending at an angle to each other. The bracket includes a shaped clement of sheet metal which includes a generally polygonal center portion defining at least three margins intersecting at respective corners for being accommodated between the stud ends. A plurality of tabs project respectively from at least two of the margins adjacent end studs of two or more stud wall subframes extending at an angle to each other, each said tab being of a length in the direction of projection greater than its width and of broadly similar order to the lengths of the longer of said margins& Respective formations are provided in each of said tabs to define alternative bending lines spaced in the direction of projection.

The center portion is preferably substantially flat. In one embodiment, the center portion is of generally square configuration, and there are four tabs projecting in oppositely directed pairs from opposite sides of the square. In another embodiment, there may also be four tabs in two oppositely directed mutually orthogonal pairs, but two of the opposed margins of the center portion are tapered towards each other for being accommodated between a complementary pair of mutually inclined surfaces of a wall stud, and wherein the respective tabs at these tapered margins are asymmetrically linked to said center portion by webs offset towards the more separated ends of the tapered margins, whereby said tab between the tapered margins can project through aligned apertures of a pair of adjacent studs.

In a still further embodiment, suited in particular to link subframes extending at an obtuse angle, e.g. 135°, to each other, the center portion is generally triangular.

The tabs are preferably bendable at the bending lines by hand.

In its first aspect, the invention also provides a tie bracket for linking adjacent end studs of two or more stud wall subframes extending at an angle to each other. The bracket comprises a shaped element of sheet metal which includes generally polygonal center portion defining at least three margins intersecting at respective corners, for being accommodated between the end studs. A plurality of tabs project respectively from at least two of the margins for engaging respective apertures in the end studs. Respective formations in the tabs define at least one bending line in each tab transverse to the direction of projection of the tab, about which lines the tab is bendable by hand to a substantial angle to the plane of the center portion to maintain engagement between the bracket and the end studs when the tabs are projected through the respective apertures in the end studs.

In this aspect of the invention, there is also provided an assembly of two or more stud wall subframes extending at an angle to each other with end studs of the respective subframes disposed adjacent to each other, wherein these end studs are linked by a bracket as aforedescribed, and wherein respective said tabs of the bracket project through apertures in the end studs and are bent over at a substantial angle to the plane of the center portion to maintain engagement between the bracket and the end studs.

In this assembly, the wall studs of the sub-frames including the end studs each comprise a structural member formed in a strip of metal sheet so that the strip is folded over onto itself at its lateral edges to form respective boxed edge formations linked by a web in which the said aperture is provided. Advantageously in this case, the center portion is shaped at least in part to complement at least a portion of the boxed edge formation of one or both end studs.

The invention further provides, in its first aspect, a method of linking adjacent end studs of two or more stud wall subframes extending at an angle to each other, utilising a tie bracket as aforedescribed, wherein the respective said tabs of the bracket are projected through preformed service apertures in the end studs and are bent over at a substantial angle to the plane of the center portion to maintain engagement between the bracket and the end studs.

In a second aspect of the invention, there is provided an assembly of a pair of stud wall subframes extending at an angle to each other with respective end studs of the subframes adjacent to each other. The end studs are connected at or adjacent to their upper ends by an angled shear connector, preferably a right angle connector, having a shorter arm which is fastened to an outer side surface of one end stud and a longer arm which extends past that stud and is connected to a side surface of the other end stud whereby to stabilise the assembly of the subframes against the action of long term shear forces.

In a third aspect, the invention provides a double stud connector of general U-shaped configuration having a web portion and a pair of flanges, the flanges have inward rib means spaced and configured whereby the connector can contact and grip about a pair of side-by-side wall studs.

BRIEF DESCRIPTION OF THE DRAWINGS

The invention will be further described, by way of example only, with reference to the accompanying drawings, in which:

FIG. 11 is an isometric view of an embodiment of double stud connector according to the third aspect of the invention; and FIG. 12 illustrates an application of the connector of FIG. 11.

DESCRIPTION OF THE PREFERRED EMBODIMENTS

Figure 1:
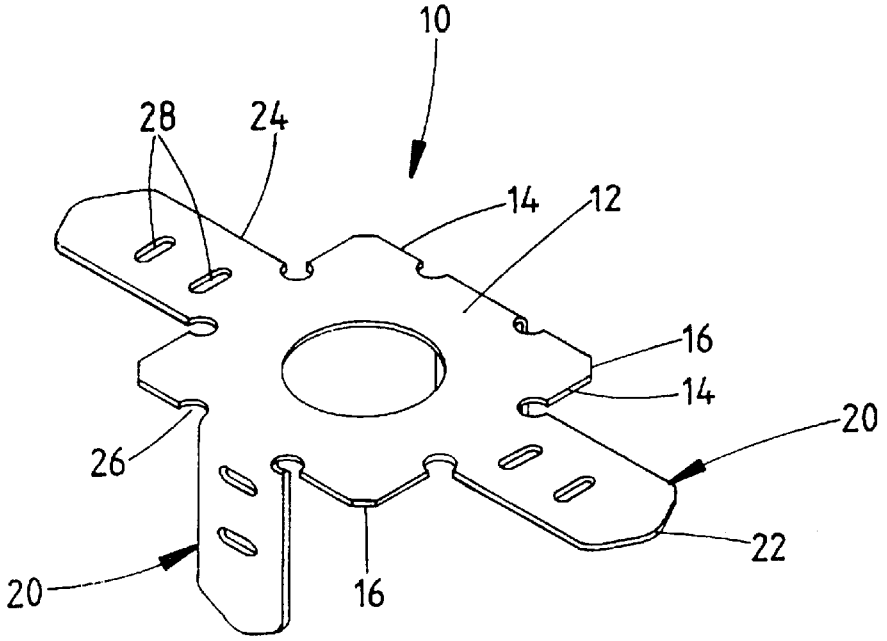
FIG. 1 is an isometric view of a stud tie bracket according to a first embodiment of the first aspect of the invention.
Figure 2:
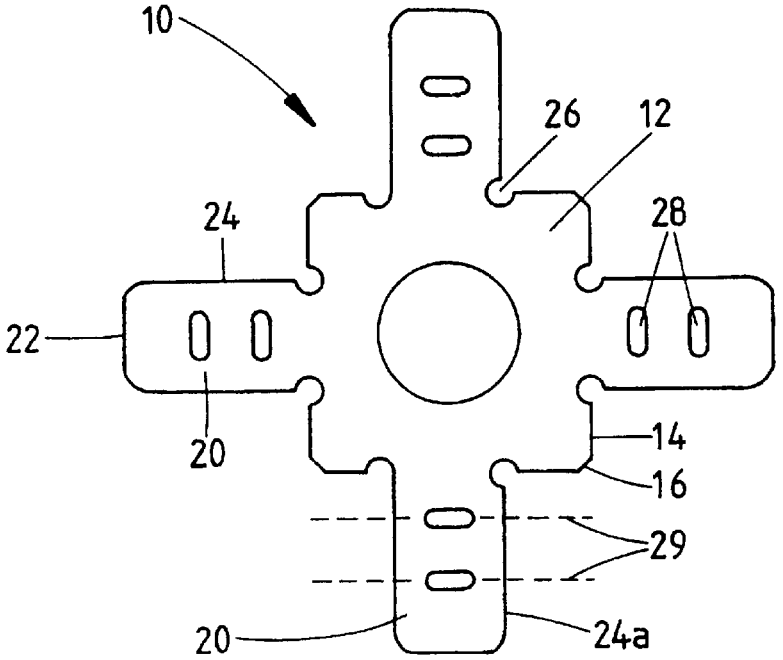
FIG. 2 is a plan view of the bracket, in a fully flat configuration.

The stud tie bracket 10 illustrated in FIGS. 1 and 2 is cut as a flat blank from a sheet or strip of steel sheet of a gauge selected to provide sufficient strength while allowing bending, preferably by hand, in the manner to be described. A suitable material is 1.2 mm steel plate coated with zinc or an alloy of zinc and aluminium.

The cut blank has a flat center portion 12 of square profile defining four equal margins 14 intersecting at rectangular corners 16 which are trimmed to prevent undesirable sharpness. Respective tabs 20 project centrally from margins 14, aligned in the flat blank in oppositely directed pairs which extend normally to each other. Each tab is broadly rectangular and longer than it is wider with side edges 24 which are parallel adjacent to center portion 12 but exhibit a shallow taper at 24*a* further out, and a tip 22 which is more broadly tapered and rounded. The inner corners of the tabs have part circular cut-outs 26 to facilitate clean bending in the line of the margins 14. Furthermore, each tab has a pair of transverse slots 28 which are spaced longitudinally of the tab and define further bending lines 29.

The longitudinal extent of each tab in the direction of projection from center portion 12 is of a similar order to the lengths of margins 14 of center portion 12.

FIG. 1 shows how the bracket would initially be shaped after being cut as a blank. i.e. two of the tabs 20 are bent down substantially at right angles to center portion 12 on the line of cut-outs 26.

Figure 3:
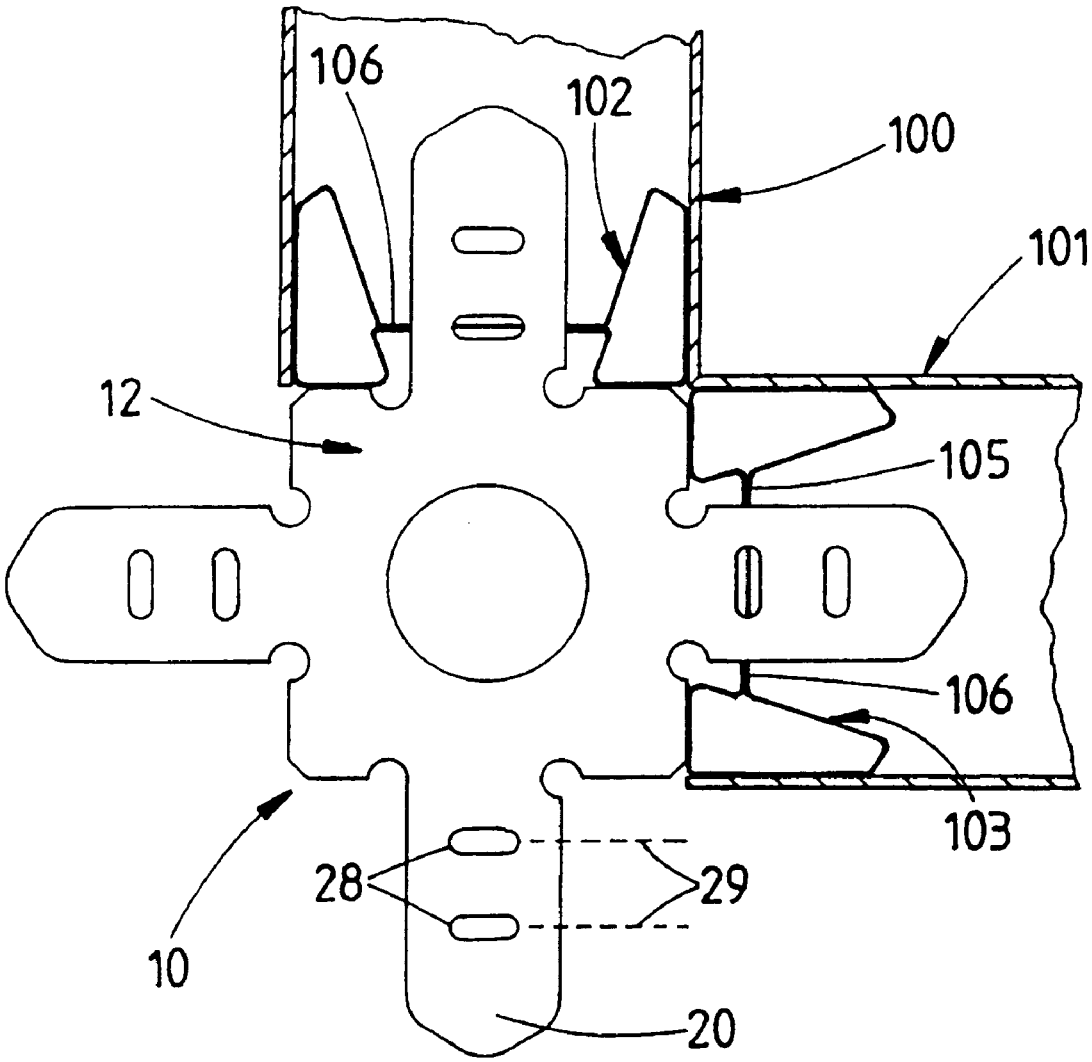
FIG. 3 is a plan view of the flattened bracket as it is positioned into service apertures in respective stud wall subframes and prior to bending of the second tab to link the subframes together at a frame corner.

At the building site, a subframe 100 (FIG. 3) is carried to the slab along with a subframe 101 for an adjacent wall and the two are positioned on the slab with end studs 102,103 of the subframes adjacent. To link the two subframes, one of the unbent tabs 20 of the bracket 10 is first projected through a mid-height service aperture 100 in an end stud 102 of one subframe 100 and bent lightly to retain the bracket. This may be done prior to delivery or prior to installation. The end stud 103 of the second subframe 101 is brought up to the-bracket so that one of the three free tabs projects through a matching service aperture 105 in the end stud 103 (FIG. 3). On bending the respective tab, the two subframes 100,101 are lightly linked. Two further subframes could be linked using the still-free tabs. This process can then be repeated for each subframe intersection in the whole frame prior to more permanent fixation.

Figure 4:
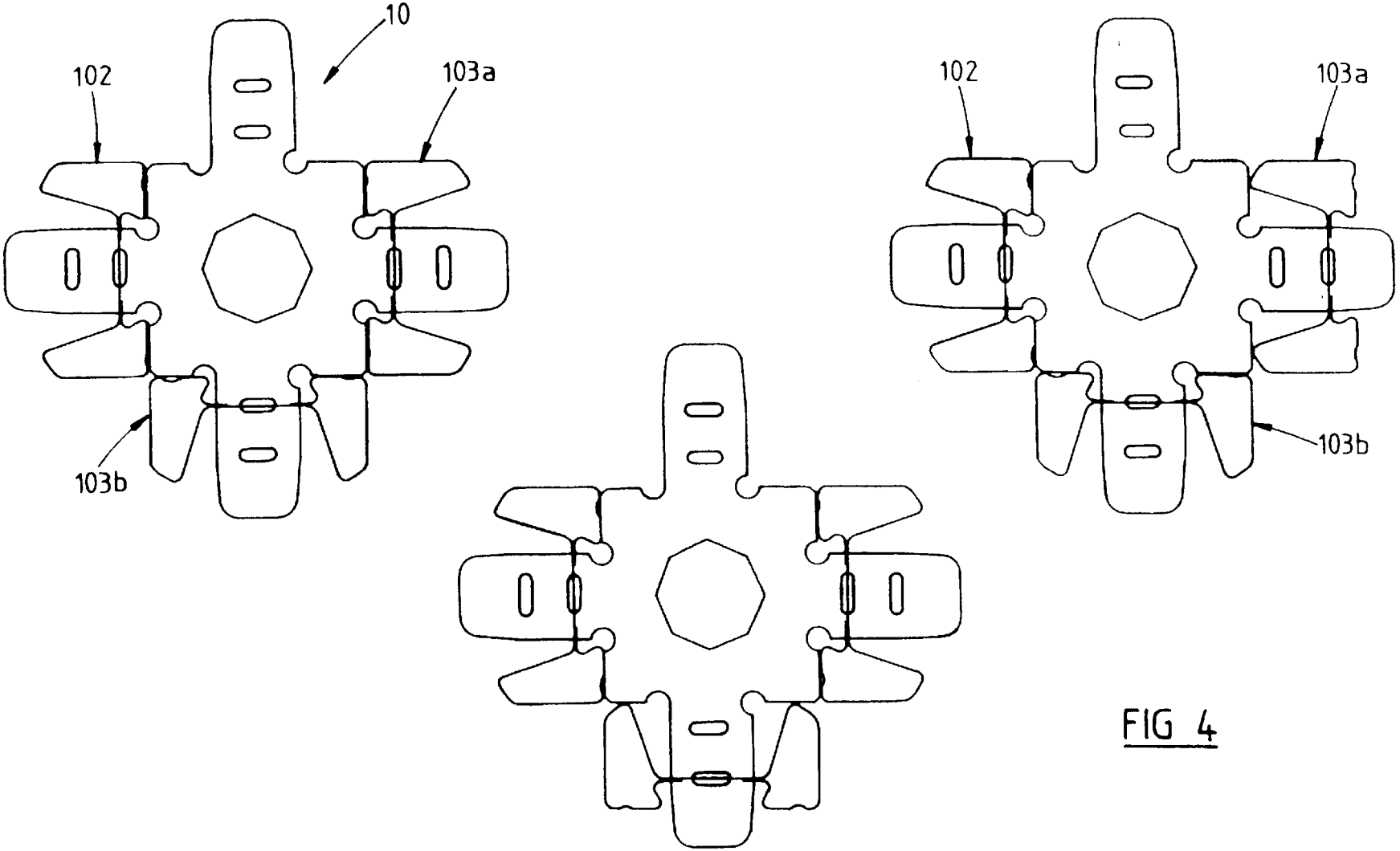
FIG. 4 depicts three plan views showing mid-panel T-junctions for different stud orientations, linked by the bracket of FIGS. 1 and 2.

In FIG. 3, the end studs are of the form shown in our Australian patent 667145. Slots 28 define two bending lines 29, i.e. lines at which the tabs would preferentially bend, suitable for the respective orientations of the stud: these lines would be positioned to be approximately at the service aperture 105 for the respective orientations. FIG. 4 is a set of similar views to FIG. 3 of alternative linking arrangements at mid-panel T-junctions for different stud orientations. Like components are indicated by like reference numerals.

It would be preferable for the tab-bending steps, or at least those on site, to be able to be done by hand, without necessarily requiring a tool.

Figure 5:
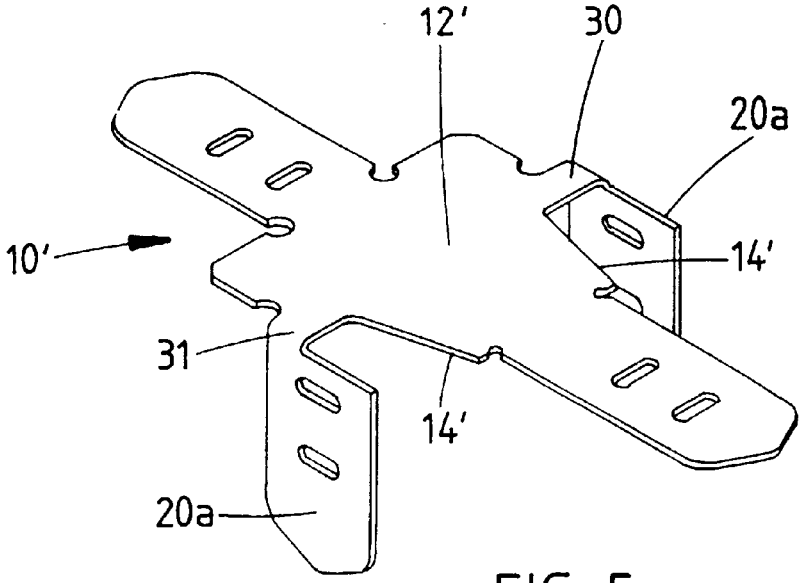
FIGS. 5 and 6 are views similar to FIGS. 1 and 2 of a further embodiment of bracket.
Figure 6:
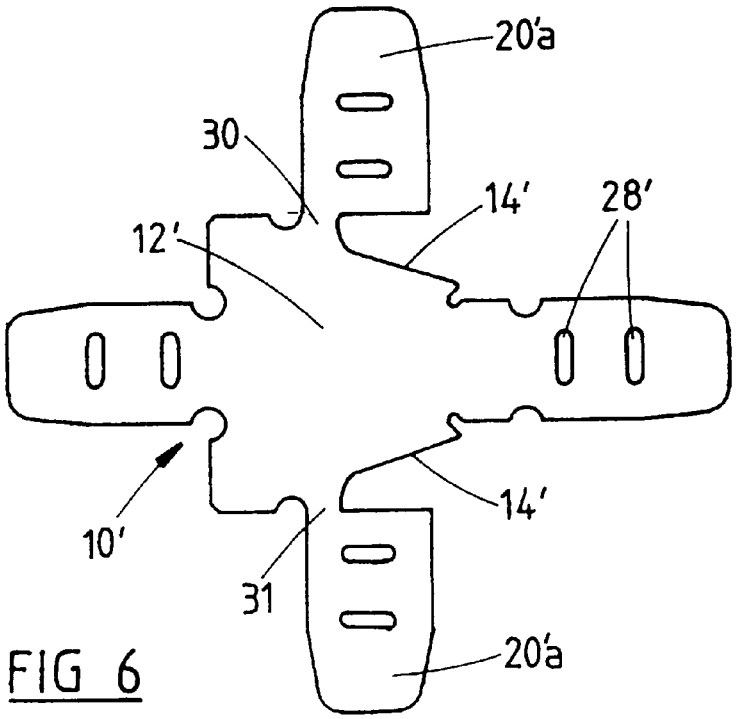
Figure 8:
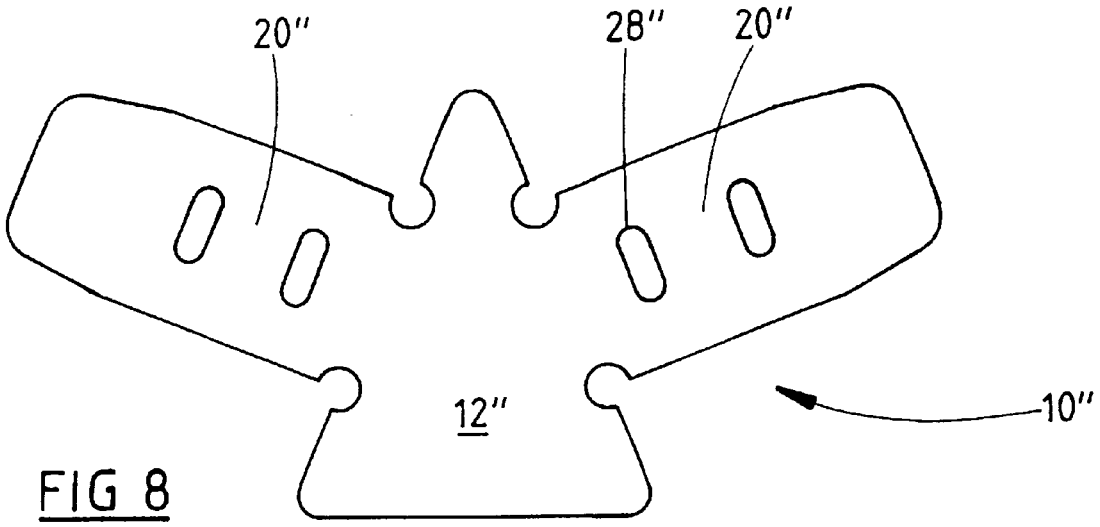
FIG. 8 is a similar view to FIG. 2 of a still further embodiment of bracket according to the first aspect of the invention.

FIGS. 5 and 6 on the one hand, and FIG. 8 on the other, show alternative embodiments of stud tie brackets 10', 10" suited to other forms of subframe intersection as illustrated. In the former case, two of the margins 14' of the center portion 12' are relieved and tapered to accommodate the inner inclined faces of a box stud of the form shown in applicant's prior Australian patent 667145. As will be appreciated, the tie bracket 10' of FIGS. 5 and 6 is more suited to a T or cross junction. In the FIGS. 5 and 6 case, it is necessary for the two tabs 20*a* projecting from the tapered margins 14' to be joined to the center portion 12' asymmetrically by offset web portions 30, 31 so that these tabs can fit around the box portions of the subframe end studs to which the bracket is originally fitted.

Figure 7:
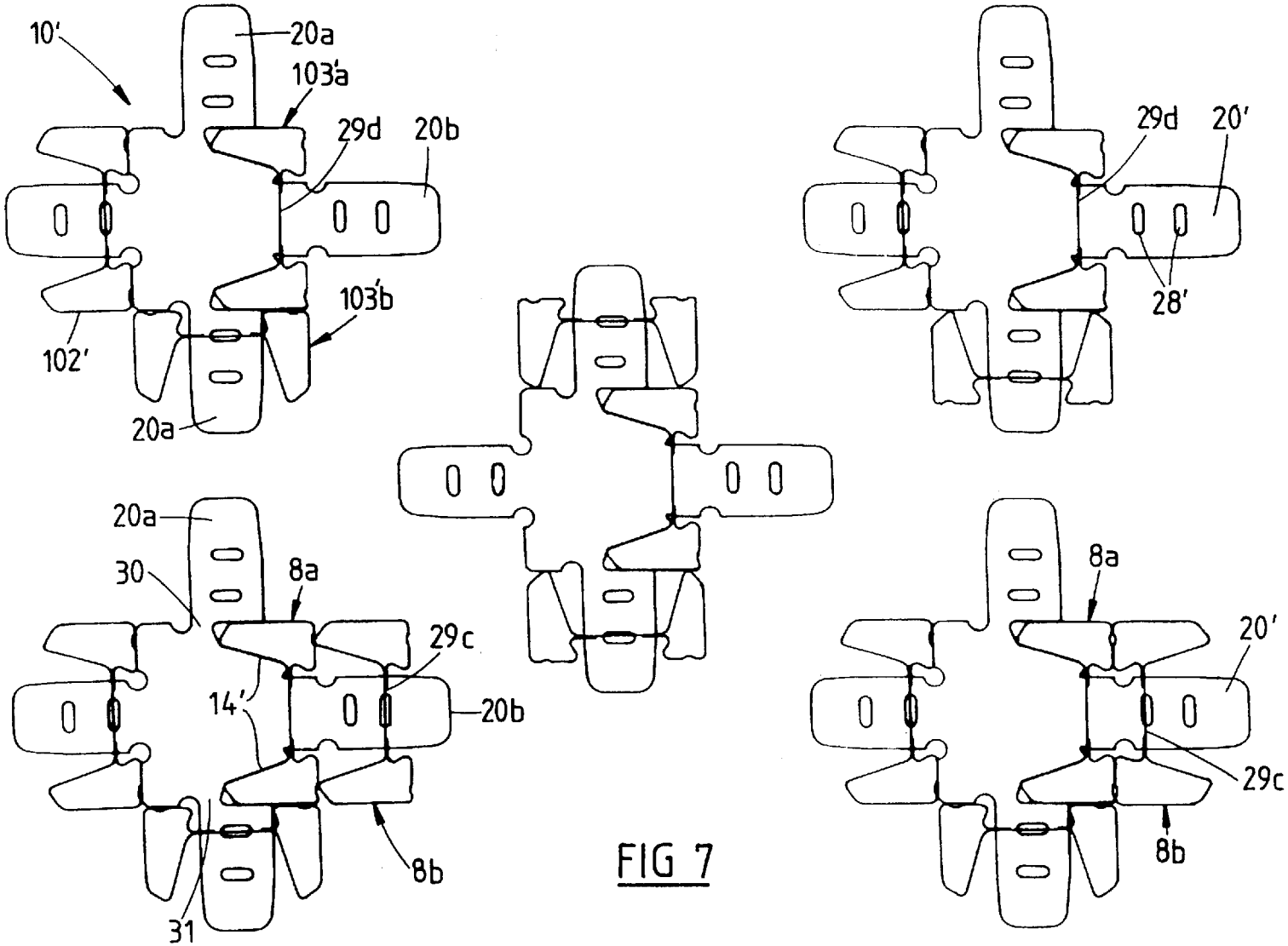
FIG. 7 shows plan views of various applications of the bracket of FIGS. 5 and 6 for different stud orientations and grippings.

FIG. 7 shows plan views of various applications of the bracket 10' of FIGS. 5 and 6. The tapered relieved arrangement allows the bracket to fully receive one side of one stud 8*a* of a pair of end studs 8*a*,8*b* so that the tab 20*b* between them can extend into aligned service apertures in both studs of the pair, with one of the tab's fold lines 29*c* at the service aperture of the second stud 8*b*, depending on the orientation of this stud. Where there is only one stud, this tab 20*b* is folded at the fold line 29*d* defined by cut-outs 26.

The bracket 10" of FIG. 8 suits a pair of subframes extending at 135° to each other and thus the center portion 12" is substantially an isosceles triangle with similar tabs 20" projecting centrally from the equal sides.

Figure 9:
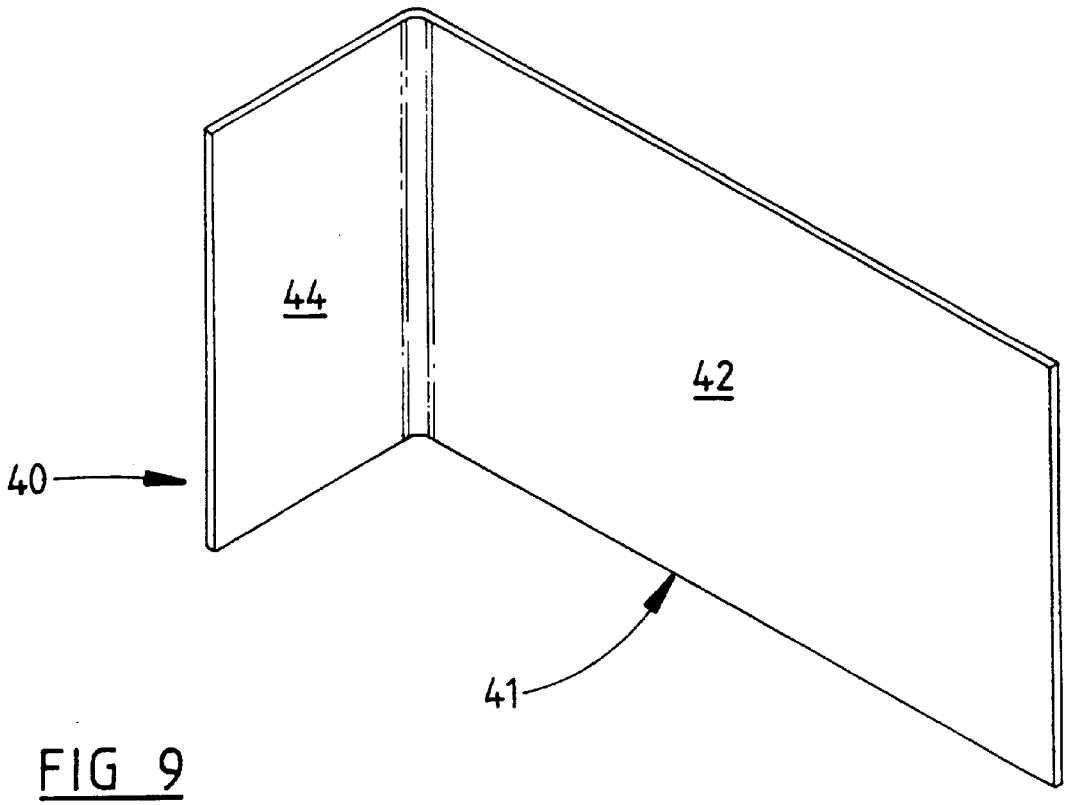
FIG. 9 depicts a shear connector according to an embodiment of the second aspect of the invention.
Figure 10:
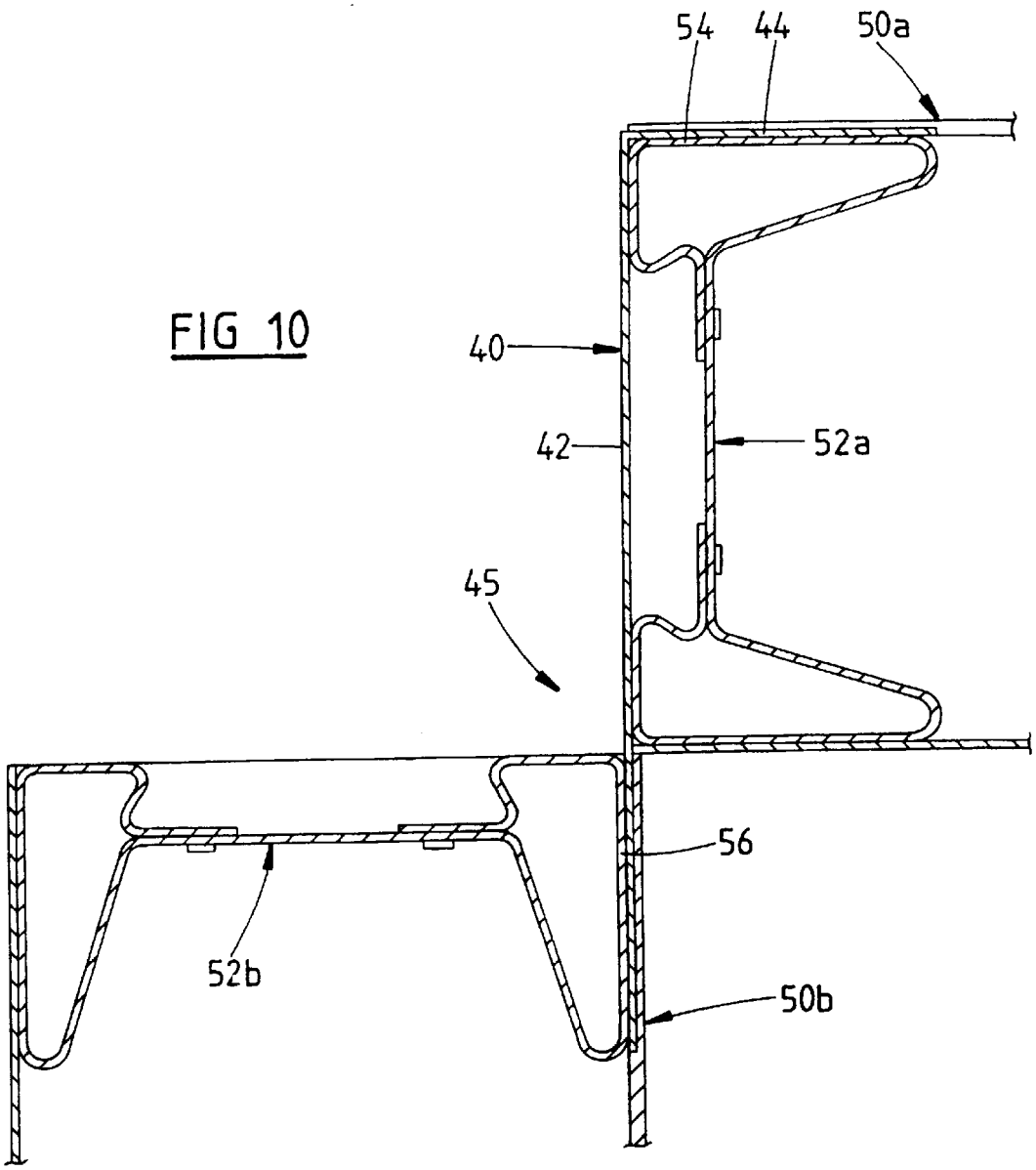
FIG. 10 is a fragmentary horizontal cross-section (in a plane just below the top plates) of a pair of stud wall subframes joined by the shear connector of FIG. 9.

FIGS. 9 and 10 illustrate an embodiment of the second aspect of the invention. To secure adjacent subframes 50*a*, 50*b* at an outside comer or T-junction 45 against forces tending to move the frames apart in the long term, adjacent end studs 52*a*,52*b* of wall subframes 50*a*,50*b* are linked by a rectangular shear connector 40 which consists of a simple component bent at 41 from steel sheet of appropriate gauge, preferably coated in zinc or an alloy of zinc and aluminium. Studs 52*a*,52*b* are again depicted as box studs of the form disclosed in our Australian patent 667145, but may of course be of any desired form and configuration. The rectangular connector 40 has a longer arm 42 and a shorter arm 44, the former being about three times longer than the other. The connector is positioned to embrace the end stud 52*a* of one of the subframes 50*a* so that short arm, 44 is fixed to an outer side face 54 of the stud on the side opposite subframe 50*b*, eg. by spot welds or clinches, while long arm 42 extends past and abuts the end face of stud 52*a* and is similarly fastened to a side face 56 of the end stud 52*b* of the other subframe 50*b*.

Connector 40 is preferably located a short distance, eg 5 to 20 cm below the tops of the subframes.

An embodiment of the third aspect of the invention is illustrated in FIG. 11, and its application is depicted in FIG. 12. This is a connector 60 for linking together pairs of adjacent wall studs, such as are to be found adjacent window or door frames. Such pairs are sometimes referred to as jamb studs.

Connector 60 is again formed in steel sheet and is of a broad U-shape, having a base web strip 62 with upturned end flanges 64,65. Flanges 64,65 each have a shallow inward V-rib 66 extending the full width of the flange, and a slightly inwardly inclined end portion 68 terminating at flange edge 69. The separation of edges 69 is a little less than the span of two adjacent boxed wall studs 70,72, but the shallow V-shape of the ribs provides a ramp formation by which the flanges 64,65 can be pushed apart to allow connector 60 to be resiliently pressed onto the stud pair, as illustrated in FIG. 12. The ribs 66 seat in grooves 73 if provided in the studs, and the press fit arising from the inclination of end portions 68 is sufficient for the connector to stay in place while it is nailed to the respective studs.

Connectors 60 are useful for stabilising and fixing wall stud pairs 70,72 as a dual stud assembly 75.

It will be appreciated that although all of the illustrated applications show the use of boxed studs of the general kind illustrated in patent 667145, open studs such as in patent 639313 might be used instead.

It will be understood that the invention disclosed and defined herein extends to all alternative combinations of two or more of the individual features mentioned or evident from the text or drawings. All of these different combinations constitute various alternative aspects of the invention.

It will also be understood that the term "comprises" or its grammatical variants as used herein is equivalent to the term "includes" and is not to be taken as excluding the presence of other elements or features.

What is claimed is:

1. A tie bracket for linking adjacent end studs of two or more wall subframes extending at an angle to each other, the bracket comprising a shaped element of sheet metal which includes:

a generally polygonal center portion defining at least three margins intersecting at respective corners, for being accommodated between said end studs;

a plurality of tabs projecting respectively from at least two of said margins for engaging respective apertures in the end studs, each tab being of a length in the direction of projection greater than its width and of broadly similar order to the lengths of the longer of said margins; and respective elongated formations in each of said tabs to define alternative lines spaced in the direction of projection, the tabs being bendable about the respective lines.

2. A tie bracket according to claim 1 wherein said center portion is substantially flat.

3. A tie bracket according to claim 1 wherein said center portion is of generally square configuration, and there are four of said tabs projecting in oppositely directed pairs from opposite sides of the square.

4. A tie bracket according to claim 1 wherein said center portion is generally triangular, for linking wall subframes extending at an obtuse angle to each other.

5. A tie bracket according claim 1 wherein said tabs are bendable at said bending lines by hand.

6. A tie bracket for linking adjacent end studs of two or more wall subframes extending at an angle to each other, the bracket comprising a shaped element of sheet metal which includes:

a generally polygonal center portion defining at least three margins intersecting at respective corners, for being accommodated between said end studs;

a plurality of tabs projecting respectively from at least two of said margins for engaging respective apertures in the end studs; and respective elongated formations in said tabs to define at least one bending line in each tab transverse to the direction of projection of the tab, about which line the tab is bendable by hand to a substantial angle to the plane of the center portion to maintain the engagement between the bracket and the end studs when the tabs are projected through said respective apertures in said end studs.

7. A tie bracket according to claim 6 wherein said center portion is substantially flat.

8. A tie bracket according to claim 6 wherein said center portion is of generally square configuration, and there are four of said tabs projecting in oppositely directed pairs from opposite sides of the square.

9. A wall frame assembly, comprising:

two or more stud wall subframes extending at an angle to each other with end studs of the respective subframes disposed adjacent to each other; and a tie bracket including a shaped element of sheet metal and linking the end studs, said shaped element including:

a generally polygonal center portion defining at least three margins intersecting at respective corners, for being accommodated between said end studs, a tab protecting respectively from each of at least two said margins for engaging respective apertures in the end studs, each said tab being of a length in the direction of protection greater than its width and of broadly similar order to the lengths of said margins, and respective formations in each of said tabs to define alternative bending lines spaced in the direction of projection, wherein respective said tabs of the bracket project through apertures in the end studs and are bent over at a substantial angle to the plane of the center portion to maintain engagement between the bracket and the end studs.

10. A wall frame assembly according to claim 9, wherein the wall studs of said subframes including said end studs each comprise a structural member formed in a strip of metal sheet so that the strip is folded over onto itself at its lateral edges to form respective boxed edge formations linked by a web in which the said aperture is provided.

11. A wall frame assembly according to claim 10 wherein said center portion is shaped at least in part to complement at least a portion of the boxed edge formation of one or both of said-end studs.

12. A wall frame assembly according to claim 9 wherein said apertures in the end studs are preformed service apertures.

13. A tie bracket for linking adjacent end studs of two or more wall subframes extending at an angle to each other, the bracket comprising a shaped element of sheet metal which includes:

a generally polygonal center portion defining at least three margins intersecting at respective corners, for being accommodated between said end studs;

a plurality of tabs projecting respectively from at least two of said margins for engaging respective apertures in the end studs; and respective formations in said tabs to define at least one bending line in each tab transverse to the direction of protection of the tab, about which line the tab is bendable by hand to a substantial angle to the plane of the center portion to maintain the engagement between the bracket and the end studs when the tabs are projected through said respective apertures in said end studs, wherein four of said tabs are provided in two oppositely directed mutually orthogonal pairs, wherein two of said margins of said center portion are tapered towards each other for being accommodated between a complementary pair of mutually inclined surfaces of a wall stud, and wherein the respective tabs at the tapered margins are symmetrically linked to said center portion by webs offset towards the more separated ends of the tapered margins, whereby said tab between the tapered margins can project through aligned apertures of a pair of adjacent studs.

14. A wall frame assembly comprising:

two or more stud wall subframes extending at an angle to each other with end studs of the respective subframes disposed adjacent to each other; and a tie bracket including a shaped element of sheet metal and linking said end studs, said shaped element including:

a generally polygonal center portion defining at least three margins intersecting at respective corners, for being accommodated between said end studs, a tab projecting respectively from each at least two of said margins for engaging respective apertures in the end studs, and respective formations in said tabs to define at least one bending line in each tab transverse to the direction of projection of the tab, about which line the tab is bendable by hand to a substantial angle to the plane of the center portion to maintain engagement between the bracket and the end studs when the tabs are projected through said respective apertures in said end studs, wherein respective said tabs of the bracket project through apertures in the end studs and are bent over at a substantial angle to the plane of the center portion to maintain engagement between the bracket and the end studs.

15. A wall frame assembly according to claim 14, wherein the wall studs of said subframes including said end studs each comprise a structural member formed in a strip of metal sheet so that the strip is folded over onto itself at its lateral edges to form respective boxed edge formations linked by a web in which the said aperture is provided.

16. A wall frame assembly according to claim 15, wherein said center portion is shaped at least in part to complement at least a portion of the boxed edge formation of one or both of said end studs.

17. A wall frame assembly according to claim 16, wherein said apertures in the end studs are preformed service apertures.

18. A tie bracket for linking adjacent end studs of two or more wall subframes extending at an angle to each other, the bracket comprising a shaped element of sheet metal which includes:

a generally polygonal center portion defining at least three margins intersecting at respective corners, for being accommodated between said end studs;

a plurality of tabs projecting respectively from at least two of said margins for engaging respective apertures in the end studs, each tab being of a length in the direction of projection greater than its width and of broadly similar order to the lengths of the longer of said margins; and respective formations in each of said tabs to define alternative bending lines spaced in the direction of projection, wherein four of said tabs are provided in two oppositely directed mutually orthogonal pairs, wherein two of said margins of said center portion are tapered towards each other for being accommodated between a complementary pair of mutually inclined surfaces of a wall stud, and wherein the respective tabs at the tapered margins are symmetrically linked to said center portion by webs offset towards the more separated ends of the tapered margins, whereby said tab between the tapered margins can project through aligned apertures of a pair of adjacent studs.

* * * * *